United States Patent [19]

Conklin, Jr.

[11] 4,211,142

[45] Jul. 8, 1980

[54] SOUND REFLECTOR FOR GRAND PIANOS

[75] Inventor: Harold A. Conklin, Jr., Cincinnati, Ohio

[73] Assignee: Baldwin Piano & Organ Company, Cincinnati, Ohio

[21] Appl. No.: 974,217

[22] Filed: Dec. 29, 1978

[51] Int. Cl.[2] ..... G10C 3/06

[52] U.S. Cl. ..... 89/189; 84/182

[58] Field of Search ..... 84/174, 177–183, 84/189–192

[56] References Cited

U.S. PATENT DOCUMENTS

| | | | |
|---|---|---|---|
| 390,169 | 9/1888 | Hudson | 84/189 |
| 890,443 | 6/1908 | Norcross | 84/178 |
| 2,134,680 | 11/1938 | Beck | 84/189 |
| 2,138,669 | 11/1938 | Tower | 84/189 |

FOREIGN PATENT DOCUMENTS

| | | | |
|---|---|---|---|
| 508518 | 7/1930 | Fed. Rep. of Germany | 84/177 |

*Primary Examiner*—Lawrence R. Franklin

*Attorney, Agent, or Firm*—Frost & Jacobs

[57] ABSTRACT

A sound reflector for use with a grand piano to reflect sound from the underside of the soundboard toward the rear side of the instrument, the reflector comprising a large panel of sound reflective material underlying the soundboard at an inclined angle with its uppermost side edges adjacent the undersurface of the front side wall of the instrument and with its lowermost side edge at floor level; the reflective panel may be planar or its sound reflecting surface may be convex in cross-section in one or more directions; brackets may be provided to detachably mount the panel to the front side wall of the case or the panel may be permanently attached to the case, as by means of hinges; and means may be provided to suspend the panel so that its lowermost side edge will clear the floor when the piano is moved.

14 Claims, 6 Drawing Figures

SOUND REFLECTOR FOR GRAND PIANOS

BRIEF SUMMARY OF THE INVENTION

The present invention relates to grand pianos, and more specifically to the provision of a reflector which will enhance the sound radiating system of the piano, particularly when the instrument is used in a concert hall of the so-called "surround" type of construction in which the stage is at the center of the hall and the audience is seated circumferentially around the stage.

The major sound source of a grand piano, the soundboard, is located in a horizontal plane. Because the strongest high frequency sound radiation from the soundboard takes place in directions which are approximately normal to the plane of the soundboard, the top or lid of the instrument plays a very important part in the sound radiating system of the piano. If the lid or top is removed from the instrument when it is being used in a large concert hall, the quality of sound from listening positions in the auditorium becomes remote and indirect, the apparent loudness drops significantly, and the quality of the sound becomes less interesting and less satisfactory from a musical standpoint. However, when the top raised and adjusted to the optimum angle, reflected sound from the top provides the benefit of redirected radiation of high frequencies throughout approximately 180°. The top also acts as a combined baffle and corner reflector which helps to prevent acoustical energy from "leaking" from the top of the soundboard to the bottom of the soundboard at least at the bass side of the instrument where the top joins the piano rim along the straight side of the instrument. In addition, it should be noted that radiation from the bottom of the soundboard at low frequencies is essentially 180° out of phase from radiation from the top of the soundboard, and consequently some cancellation of low frequencies will occur for equal path lengths from the listener to the top and bottom of the instrument. The open lid of the piano also serves to reduce part of this cancellation, making the radiation of the low frequencies from the instrument somewhat more efficient than without a lid.

In concert halls of the "surround" type of construction, part of the audience is located to the rear side of the instrument where the raised top, which projects sound toward that part of the audience seated on the front side of the instrument, acts to block the sound from those seated on the rear side. The present invention in large measure overcomes this difficulty by providing an additional reflective surface arranged to project the sound toward members of an audience seated on the rear side of the instrument.

In accordance with the invention, a large sound reflecting panel is placed beneath the soundboard of the instrument and so situated as to act as an integral part of the sound radiating system of the piano. The reflecting panel may comprise a flat piece of relatively heavy and thick material, such as plywood, or it may comprise a sheet of plastic having reflective characteristics. In an alternative embodiment of the invention, the reflecting surface of the panel may be convex in cross-section to effect a spreading-out of the reflected sound, and the convexity may be employed in more than one direction if desired.

The refective panel may or may not be attached to the instrument, although preferably it will be detachably secured to the instrument by means of brackets designed to engage the piano rim on the treble side of the instrument. The lowermost edge of the reflective panel may rest on the floor of the stage when in use, although means may be provided to suspend the lowermost edge of the reflective panel above the floor when the piano is being moved from one location to another.

DETAILED DESCRIPTION

Figure 1:
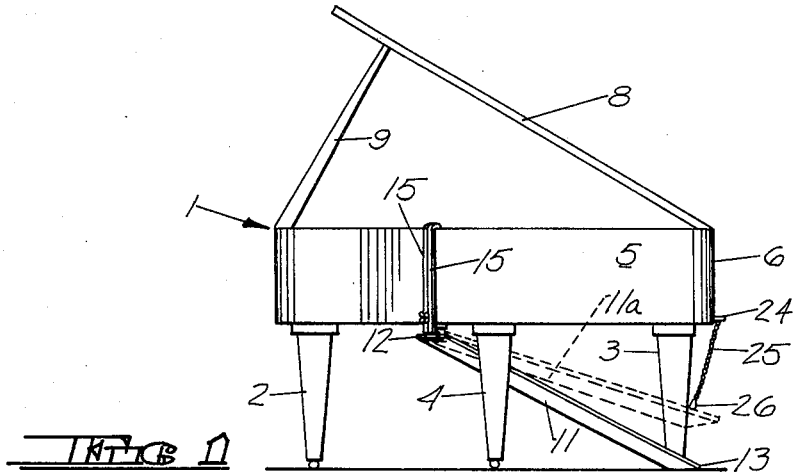
FIG. 1 is an elevational view of a grand piano incorporating the present invention taken from the rear or tail end of the instrument.
Figure 2:
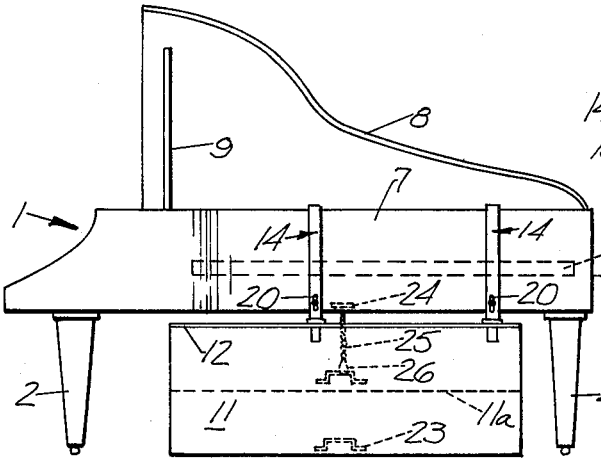
FIG. 2 is a side elevational view of a grand piano taken from the front side thereof.
Figure 3:
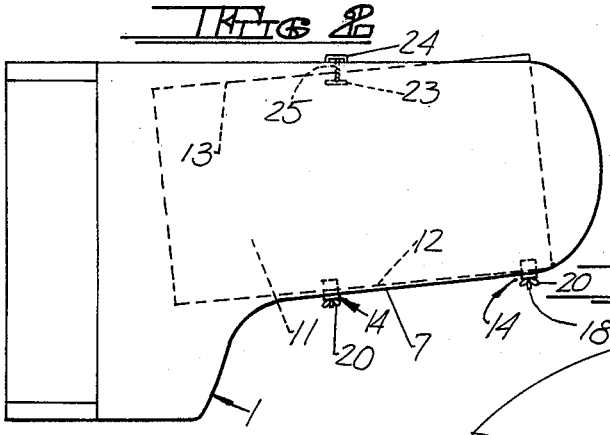
FIG. 3 is a plan view of the piano.

FIGS. 1 through 3 illustrate a conventional grand piano having a case 1 supported by a pair of front legs 2 and 3, and a rear leg 4. The case has an upstanding rim 5 which defines an essentially straight or planar rear side wall 6 and a contoured front side wall 7. The conventional grand piano is provided with a lid 8 hingedly connected to the uppermost edge of rear side wall 6, the lid being supported in elevated position by means of support arm 9. Mounted within the case is a horizontally disposed soundboard, diagrammatically indicated at 10, which radiates the sound generated by the strings when they are vibrated by the playing action.

In accordance with the invention, a sound reflector in the form of a large reflective panel 11 is mounted beneath the soundboard and positioned to reflect sound from the underside of the soundboard in the direction of the rear side of the instrument. The reflective panel 11 is preferably of rectangular shape and of a size such that its uppermost side edge 12 will lie along the undersurface of the front side wall 7, with its lowermost side edge 13 underlying the rear side wall 6 and in contact with the floor of the stage or other supporting surface for the instrument. In the embodiment illustrated in FIGS. 1 through 3, the sound reflective panel comprises a flat piece of sound reflective material, which may be wood or plastic. For example, the reflective panel may comprise a sheet of plywood having a thickness of at least about three-fourths inch. Where the reflective panel is made from wood, it will be normally finished to correspond to the finish of the piano, which in the case of a concert grand is normally black. The reflective panel may, however, be formed from plastic materials, such as Lucite, in which event the panel will have a thickness of from about three-eights inch to about three-fourths inch. The plastic may be transparent, in which case it will be essentially invisible to the audience, or it may be opaque or colored if a decorative effect is desired. While the size of the reflective panel may vary, in an exemplary installation for a piano of concert grand size (nine feet long), a reflective panel having a length of sixty-one inches and a width of forty-eight inches has been found to produce excellent results. An essentially rectangular panel is preferred, although other configurations may be utilized consistent with the objective of reflecting sound toward the rear side of the instrument.

Figure 4:
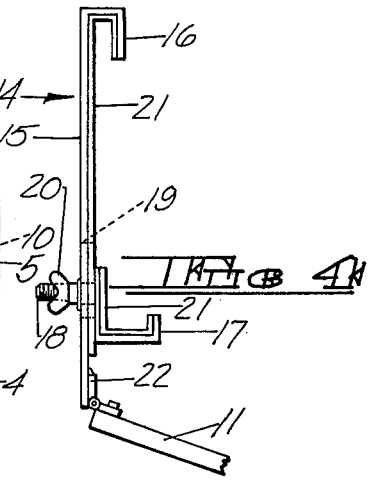
FIG. 4 is an enlarged fragmentary side elevational view of a mounting bracket for the reflective panel.

The reflective panel may or may not be attached to the instrument. If a particular instrument is to be used only in a "surround" hall, permanent attachment may be advantageous, although for most installations it is preferred to attach the panel by means of brackets so that it may be readily attached to the piano or removed as required. Alternatively, the reflective panel may be mounted on a supporting stand without direct connection to the piano case. In the embodiment illustrated, the reflective panel is mounted to the case by means of a pair of brackets 14 designed to engage over the uppermost edge of front side wall 7. As best seen in FIG. 4, each of the brackets 14 comprises an elongated strap-like body 15 having a length slightly longer than the top to bottom dimension of the front side wall 7, the bracket being configured at its uppermost ends to provide a hook portion 16 adapted to engage over the upper edge of the front side wall. Preferably, a second hook 17 will be adjustably secured to the body of the bracket toward its lowermost end to engage the underside of the rim. The hook 17 has a threaded pin 18 extending through an elongated slot 19 in the body portion of the bracket, the pin being engaged by a wing nut 20, thereby permitting hook 17 to be easily adjusted to secure the bracket to the case. Hook 17 normally will be wider than hook portion 16 since most piano cases have an inner rim portion along their bottom edge. The bracket preferably will have cushioning material 21 secured to its inner surface, including hook 17, so that it will not mar the finish of the case. At its lowermost end, the bracket is provided with an attachment means, preferably in the form of a hinge 22, by means of which the reflective panel 11 may be hingedly secured to the brackets. While the reflective panel could be rigidly fixed to the lowermost ends of the brackets, the hinged construction is preferred to facilitate elevation of the lowermost end of the reflective panel when the piano is being moved from one place to another. Of course, if the reflective panel is to be permanently secured to the case, the hinges 22 may be utilized to hingedly connect the reflective panel directly to the underside of front side wall 7.

If the piano is to be moved with the reflective panel in place, it is preferred to provide means to lift the lowermost side edge of the panel out of contact with the floor. To this end, the panel may be provided with a handle 23 secured to the reflective surface of the panel adjacent its lowermost edge. In addition to enabling the panel to be readily lifted, the handle also may be utilized to maintain the lowermost edge of the panel in an elevated position, the rear side wall of the rim being provided with a bracket 24 to which one end of a length of flexible member 25, such as a cable or chain, may be attached, the flexible member having a clasp 26 at its opposite end engagable with the handle 23. The length of the flexible member will be chosen so that, when engaged with the handle, it will suspend the lowermost edge of the panel above the floor in the manner indicated in dotted lines at 11*a* in FIGS. 1 and 2.

Figure 5:
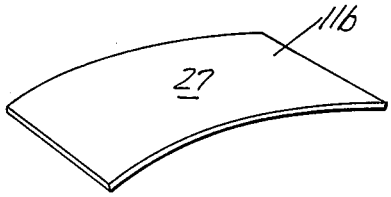
FIG. 5 is a diagrammatic perspective view of a reflective panel which is convex in cross-section.
Figure 6:
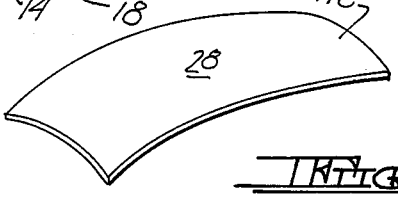
FIG. 6 is a perspective view of a reflective panel which is convex in cross-section in two planes.

Tests of a reflective panel made and attached to a concert grand piano in the manner described, show that the panel is effective in providing for persons seated to the rear of the instrument a quality of musical sound far superior than if a standard instrument were used without the reflective panel. The tests also indicate that this effect is achieved without a serious reduction in the quality of the sound radiated to members of the audience seated on the front side of the instrument. While the invention is most effective for providing improved sound for listeners seated to the rear of the instrument, the amount of improvement for persons seated at the ends of the instrument is less than for those seated at the sides because a smaller amount of reflected sound is received at these locations. However, in order to increase the angle over which substantially improved performance is obtained, the reflecting surface of the panel may be made convex in cross-section to effect a spreading-out of the reflected sound. Thus, as illustrated in FIG. 5, the reflective surface 27 of panel 11*b* may be convex in longitudinal cross-section. Similarly, as illustrated in FIG. 6, the reflective surface 28 of panel 11*c* may be convex in cross-section in both directions i.e., both longitudinally and laterally of the panel. Where convex shapes are utilized, the reflective panels are preferably formed from a plastic material which may be easily formed to the desired shape. In exemplary embodiments, the convex curvatures of the panels may be formed as arcs of circles having a radius of from about six feet to about ten feet.

What is claimed is:

1. A sound reflecting system for a grand piano having a case including a vertically disposed rim defining a contoured front side wall and an essentially planar rear side wall, a lid hingedly connected to the rear side wall of the rim, and a horizontally disposed soundboard mounted within said rim, said lid being elevated so as to lie at an inclined angle with respect to said case, a sound reflector underlying the case of the piano, said sound reflector comprising a panel of sound reflecting material of a size to underlie the soundboard, said reflective panel lying at an inclined angle with its uppermost side edge adjacent the undersurface of the front side wall of the rim and with its lowermost side edge underlying the rear side wall of the rim at floor level, and means for mounting the reflective panel beneath the piano case , said elevated lid reflecting sound forwardly from the top of the case and said sound reflector reflecting sound rearwardly from the bottom of the case, whereby to enhance the distribution in all directions of sound radiated by the soundboard.

2. The sound reflecting system claimed in claim 1 wherein said reflective panel comprises an essentially rectangular wooden panel.

3. The sound reflecting system claimed in claim 2 wherein said reflective panel comprises a planar sheet of plywood having a thickness of about three-fourths inch.

4. The sound reflecting system claimed in claim 1 wherein said reflective panel is formed from a plastic material having a thickness of from about three-eights inch to about three-fourths inch.

5. The sound reflecting system claimed in claim 1 wherein the sound reflecting surface of said reflective panel is convex in cross-section in at least one direction.

6. The sound reflecting system claimed in claim 5 wherein the sound reflecting surface of said reflective panel is convex in cross-section in two directions lying at right angles to each other.

7. The sound reflecting system claimed in claim 5 wherein the convex curvature of the sound reflecting surface of the reflective panel is defined by the arc of a circle having a radius of from about six feet to about ten feet.

8. The sound reflecting system claimed in claim 1 wherein said mounting means comprises a plurality of elongated bracket members each having a hook-like upper end adapted to engage over the upper edge of the front side wall of the rim, and including attachment means at the lower end of the bracket for securing the bracket to the reflective panel adjacent its uppermost side edge.

9. The sound reflecting system claimed in claim 8 wherein said bracket includes an adjustable hook member engagable beneath the lower edge of the front side wall of the rim.

10. The sound reflecting system claimed in claim 9 wherein said attachment means includes a hinge, whereby the sound reflective panel is pivotally mounted relative to the piano case.

11. The sound reflecting system claimed in claim 1 wherein said mounting means includes hinge means for pivotally connecting the reflective panel to the piano case.

12. The sound reflecting system claimed in claim 11 including suspension means for supporting the lowermost side edge of the reflective panel in spaced relation to the floor.

13. The sound reflecting system claimed in claim 12 wherein said suspension means comprises a flexible cable secured at one end to the rear side wall of the case and at its opposite end to said reflective panel.

14. The sound reflecting system claimed in claim 13 wherein said suspension means includes a handle member secured to the sound reflecting surface of the reflective panel adjacent its lowermost side edge, and clasp means for detachably connecting said flexible cable to said handle.

* * * * *